US006024159A

United States Patent [19]

Woycik et al.

[11] Patent Number: 6,024,159

[45] Date of Patent: Feb. 15, 2000

[54] PRESSURE CASTING METHOD WITH RECOVERABLE MELT OUT CORE

[75] Inventors: Greg Woycik, Clarkston; Randall Zeimet, Troy; Karl Voss, West Bloomfield, all of Mich.

[73] Assignee: Hayes Lemmerz International, Inc., Northville, Mich.

[21] Appl. No.: 09/060,798

[22] Filed: Apr. 14, 1998

[51] Int. Cl.[7] ..... B22C 3/00; B22C 9/10; B22D 18/02; B22D 29/00

[52] U.S. Cl. ..... 164/120; 164/132; 164/138

[58] Field of Search ..... 164/120, 132, 164/138

[56] References Cited

U.S. PATENT DOCUMENTS

| | | | |
|---|---|---|---|
| 1,544,930 | 7/1925 | Pack | 164/132 |
| 3,258,816 | 7/1966 | Rearwin | 164/132 |
| 5,263,531 | 11/1993 | Drury et al. | 164/132 X |
| 5,355,933 | 10/1994 | Voss | 164/132 X |

FOREIGN PATENT DOCUMENTS

| | | | |
|---|---|---|---|
| 48-32053 | 10/1973 | Japan . | |
| 52-14521 | 2/1977 | Japan . | |
| 53-46438 | 4/1978 | Japan | 164/132 |
| 63-183769 | 7/1988 | Japan . | |
| 63-199060 | 8/1988 | Japan . | |
| 3-294055 | 12/1991 | Japan . | |
| 334714 | 9/1930 | United Kingdom | 164/132 |

*Primary Examiner*—J. Reed Batten, Jr.
*Attorney, Agent, or Firm*—MacMillan, Sobanski & Todd, LLC

[57] ABSTRACT

A zinc alloy melt-out core comprises from 0.75% to 3% Cu, from 0% to 0.3% Ni, from 0% to 0.5% Al, and balance Zn. The zinc alloy melt-out core is used in pressure casting processes for producing an aluminum article having a hollow. The zinc alloy core has a shape-imparting outer surface. In the pressure casting process, the zinc alloy core preserves a space corresponding to the hollow. The zinc alloy core has improved hot strength and thus maintains its integrity during the pressure casting process, inhibiting seepage of the core material into the aluminum cast article. Preferred zinc alloy melt-out cores further comprise an outer coating of insulating material selected from the group consisting of mica, graphite, ceramics and combinations thereof.

10 Claims, No Drawings

PRESSURE CASTING METHOD WITH RECOVERABLE MELT OUT CORE

FIELD OF THE INVENTION

The present invention relates generally to melt-out cores which are useful in aluminum die casting processes known in the art, particularly pressure casting processes. The zinc alloy melt-out cores of the present invention provide enhanced physical properties such as improved shape retention during casting of an aluminum article having a hollow or cavity.

BACKGROUND OF THE INVENTION

Metal die casting processes, such as the squeeze casting process described in U.S. Pat. No. 5,355,933, are well known in the art. Molten casting metal, usually aluminum or aluminum alloys, is introduced into a die and a great amount of pressure is exerted on the metal as it solidifies to essentially squeeze-form the article in the die producing a metal article having a lower porosity and improved mechanical properties as compared to the same article produced by more conventional lower pressure casting methods. In order to provide a hollow or cavity in the pressure cast article, a melt-out core is inserted into a die cavity prior to casting the molten metal in the die. The melt-out core, preferably coated with insulating mica material and a graphite release agent, is supported in the die cavity of a high-pressure squeeze casting apparatus. Molten casting metal having a melting temperature above that of the core is injected into the die and pressurized to about 15,000 psi to squeeze-form the article in the die and around the core. The molten casting metal is allowed to solidify in the die cavity and about the insulated core. The core preserves a space defining the hollow or core in the cast article. The resultant aluminum cast article and core are then heated to above the melting temperature of the core. The core material is then melted or liquified and extracted from the article leaving the aluminum article having a hollow.

In high-pressure aluminum casting processes, zinc melt-out cores have been described for use in forming an aluminum cast article having a cavity. In these processes, the zinc melt-out core is used as described above to preserve a space in the casting process corresponding to the cavity in the aluminum cast article. One significant problem with these high-pressure aluminum casting processes is the inability of the zinc core to maintain its integrity throughout the casting process. That is, during the casting process, the zinc core material seeps into the aluminum material forming the pressure cast article. This is believed to be caused by either capillary diffusion of the zinc when the aluminum solidifies, or by the zinc expanding when it melts when molten aluminum is cast about the zinc core. Thus, zinc melt-out cores do not provide sufficient "hot strength" to maintain its integrity during an aluminum pressure casting process. As such, the zinc seeps into the aluminum article during the casting process. This results in potential points of failure in the aluminum cast article which are unacceptable.

To address this problem, the prior art has applied various outer coatings to the zinc melt-out core in an attempt to maintain the core's integrity during the casting process. Such core materials include refractory materials including aluminum oxide, water glass, mica and graphite. These materials have not been completely successful and add additional cost to the casting process. Thus, there has been a need for an improved pressure casting process which results in an aluminum cast article having a hollow.

SUMMARY OF THE INVENTION

The zinc alloy melt-out cores of the present invention provide enhanced physical properties in pressure casting processes. In particular, the zinc alloy melt-out cores are for use in pressure casting processes which produce an aluminum article having a hollow. In a disclosed embodiment of this invention, the zinc alloy core has a shape-imparting outer surface and comprises, by weight of the core, from 0.75% to 3% Cu, from 0% to 0.3% Ni, and from 0% to 0.5% Al, the balance being Zn, but may additionally include up to about 0.5% impurities and other additives. The zinc alloy core preserves a space during the pressure casting process corresponding to the hollow. The zinc alloy core maintains its integrity during the pressure casting process and inhibits seepage of the core material into the aluminum article. The zinc alloy core does this primarily through improved hot strength through alloying of the zinc with the copper, nickel and aluminum. A preferred level of Ni in the above zinc alloy melt-out core is from 0.15% to 0.25% by weight. A preferred level of Al in the zinc alloy melt-out core is from 0.15% to 0.5% by weight. The preferred level of Cu in the zinc alloy core is from 1% to 2% by weight. Preferred zinc alloy melt-out cores of the present invention include between about 1.5% and 4% Cu, Ni and Al. A particularly preferred zinc alloy melt-out core comprises 2% Cu and 0.2% Ni. Another particularly preferred zinc alloy melt-out core comprises 1% Cu, 0.2% Ni, 0.2% Al, the balance being zinc.

In a preferred embodiment of this invention, the zinc alloy core comprises, by weight of the core, up to about 4% of Cu, Ni and Al, and at least 0.75% Cu, at least 0.1% Ni, and at least 0.1% Al. As with the core described above, the zinc alloy core preserves a space during the pressure casting process corresponding to the hollow such that the zinc alloy core maintains its integrity during the pressure casting process, inhibiting seepage of the core material into the aluminum article. A preferred level of Ni in the zinc alloy melt-out core is up to 0.3% by weight. A preferred level of Al in the zinc alloy melt-out core is up to 0.5% by weight. The preferred level of Cu in the zinc alloy melt-out core comprises from 1% to 2% by weight.

The zinc alloy melt-out cores of the present invention may comprise an outer coating of an insulating material. Such insulating materials may be selected from the group consisting of mica, graphite, ceramics and combinations thereof. The insulating material is applied as a thin layer or coating to the outer surface of the core and conforms substantially to the outer surface of the core. The insulating material insulates the metal core from the heat of the molten casting aluminum sufficiently to aid in the prevention of the melting of the core material. Preferably, the coating of insulating material has a thickness of about 0.01 to 0.03 inches.

In a method according to the present invention, a zinc alloy melt-out core having an outer shape-imparting surface is formed comprising, by weight of the core, from 0.75% to 3% Cu, from 0% to 0.3% Ni, from about 0% to 0.5% Al, and balance zinc. The core is then disposed in a die cavity of a high-pressure casting die with the outer surface of the core exposed for preserving a space within the cavity corresponding to a hollow space to be formed within an aluminum cast article. Molten aluminum is introduced into the die cavity and against the core. The method then includes pressurizing the aluminum sufficient to squeeze form the article in the die and around the core. The core is able to withstand the heat of the molten aluminum to an extent sufficient to inhibit the core from losing its original shape and the core material from seeping into the aluminum during casting of the article. The molten aluminum is then allowed to solidify in the die cavity and about the core. After the aluminum article and zinc alloy core have solidified, the die is opened and the cast article and core are removed from the die cavity. The core is then extracted from the aluminum cast article by heating the article and the core to a temperature above the melting temperature of the core material but below that of the aluminum. The core material is liquified and then extracted, leaving an aluminum cast article with a hollow.

In a preferred method of the present invention, the step of forming the zinc alloy melt-out core includes forming the core by a continuous casting process wherein the core comprises, by weight, 1% to 2% Cu, 0.15% to 0.25% Ni, and 0.15% to 0.5% Al. Another preferred method further comprises collecting the molten core material and allowing the nickel and aluminum to form a slag on the molten core material and then skimming the slag from the molten core material. Yet another preferred method comprises using the molten core material to produce a recycled zinc alloy melt-out core as described above for use in a subsequent aluminum casting process.

These and other features of the present invention will be best understood from the following detailed description of a preferred embodiment.

DETAILED DESCRIPTION OF A PREFERRED EMBODIMENT OF THE INVENTION

The present invention relates to melt-out cores comprising zinc and low levels of specific alloying metals. The low levels of alloying metals keeps the melting point of the zinc alloy melt-out core very close to the melting point of pure zinc, i.e., about 740° F. The zinc alloy melt-out cores may be used in aluminum die casting processes to produce an aluminum part having a hollow. Molten aluminum is cast around the zinc alloy melt-out core in a die cavity of a pressure or squeeze casting process. The core preserves a space in the aluminum cast article which corresponds to the hollow in the aluminum article. As described in the process of the present invention hereinbelow, the molten aluminum is allowed to solidify in the die and then the article and core are heated to a temperature above the melting temperature of the core material but below that of the aluminum forming the cast article.

The zinc alloy melt-out core melts and is then extracted from the article, leaving behind the resultant hollow within the aluminum article.

The zinc alloy melt-out core of the present invention comprises primarily zinc and, by weight of the core, from 0.75% to 3% Cu, from 0% to 0.3% Ni, and from 0% to 0.5% Al, the balance being zinc. As used herein, the term balance zinc may additionally include up to about 0.5% impurities and additives. These zinc alloys provide improved "hot strength" and thus help maintain the integrity of the zinc alloy core during the aluminum pressure casting process described in further detail below. The improved hot strength also inhibits seepage of the zinc alloy core material into the aluminum article during the casting process. Zinc comprises a predominant portion of the zinc alloy melt-out core because it has a melting temperature relatively lower than that of the aluminum casting metal. As stated above, zinc has a melting temperature of about 740° F., whereas aluminum has a melting temperature of about 1,350° F. Thus, in pressure casting processes of the present invention, the zinc alloy melt-out core can be easily extracted from the aluminum cast article in a manner described below.

It has been found that certain alloying metals help zinc retain elevated temperature strength, i.e., improve zinc's "hot strength". In particular, low levels of copper help zinc retain its hot strength and thus provide improved physical characteristics of a zinc alloy melt-out core. However, these low levels of alloying metals does not significantly raise the melting temperature of the core. Thus, the zinc alloy melt-out cores of the present invention comprise, by weight of the core, from 0.75% to 3% Cu. Preferably, the zinc alloy melt-out cores comprise from 1% to 2% Cu, most preferably 1% Cu. Relative to super high grade zinc melt-out cores, copper significantly increases the strength of the melt-out core in terms of compression strength at elevated temperatures (up to about 450° F.) and bending strength at elevated temperatures (up to about 600° F.). These improved physical characteristics help the zinc alloy melt-out core maintain its integrity during a pressure casting process and thus helps inhibit seepage of the core material into the aluminum article during the process. During the casting process the zinc alloy core is surrounded by molten aluminum which has a melting temperature of about 1,350° F. Super high grade zinc has a melting temperature of about 740° F. Although the zinc alloy melt-out cores of the present invention have a melting temperature similar to super high grade zinc, these cores are able to maintain their integrity to a much greater extent than zinc melt-out cores as a result of their improved compression and bending strengths at elevated temperatures. Thus, in a pressure casting process such as the process described below, the zinc alloy melt-out core is better able to maintain its shape imparting surface during the casting process and prevent seepage of the core material into the aluminum article.

The zinc alloy melt-out cores of the present invention may also comprise, by weight of the core, from 0% to 0.3% Ni. Preferably, the level of Ni in the zinc alloy melt-out cores is, by weight, 0.15% to 0.25%, most preferably 0.2%. Copper and nickel are mutually soluble in each other at essentially all concentrations as is evident from their binary phase diagram. Thus, copper and nickel do not combine to form intermetallic compounds in the zinc alloy melt-out cores during the casting process. In the presence of zinc, the copper and nickel should each separately combine with zinc.

At concentrations of 1% Cu and 2% Cu, a low level of nickel improves the compression strength and bending strength of the zinc alloy melt-out cores. Thus, the preferred level of Ni in the zinc alloy cores is from 0.15% to 0.25% by weight. A preferred level of Ni in the zinc alloy melt-out core is 0.2%. One particularly preferred zinc alloy core comprises, by weight, 2% Cu and 0.2% Ni. Another particularly preferred zinc alloy core comprises, by weight, 1% Cu and 0.2% Ni.

The addition of nickel and aluminum to the zinc alloy core results in the formation of intermetallics (nickel aluminides) which rise to the surface of molten zinc alloy material which can be skimmed off in a preferred process described below. Thus, preferred zinc alloy cores of the present invention comprise, by weight, from 0%, to 0.5% Al. A preferred level of Al in the zinc alloy cores is from 0.15% to 0.5% by weight Al. A most preferred level of Al in the zinc alloy cores is 0.2% by weight Al. Low levels of aluminum in the zinc alloy cores of the present invention provided a beneficial increase in bending strength and compression strength. In fact, because zinc alloy cores of the present invention will be in intimate contact with molten aluminum, tolerance to aluminum contamination is important. Thus, since aluminum improves the physical characteristics of the zinc alloy melt-out cores, this was seen as a significant unexpected benefit.

Particularly preferred zinc alloy melt-out cores of the present invention comprise, by weight of the core, 1% Cu, 0.2% Ni and 0.2% Al. As compared to super high grade zinc melt-out cores, this zinc alloy melt-out core provides significantly better physical characteristics including compression strength and bending strength at elevated temperatures, i.e., at temperatures up to about 400° F. and 600° F., respectively. The improved physical characteristics of this zinc alloy melt-out core helps maintain the integrity of the core during aluminum casting processes, including the pressure casting process described below. The zinc alloy melt-out core is better able to maintain its shape imparting surface and inhibits seepage of the core material into the aluminum article during the casting process.

In other preferred zinc alloy melt-out cores, the total weight of Cu, Ni and Al is at least about 1.5%, by weight of the core. Preferably, the total weight of Cu, Ni and Al is between about 1.5% and 4%, by weight of the core. In another zinc alloy melt-out core, the total weight of Cu, Ni and Al in the zinc alloy melt-out core is up to about 4%, by weight of the core, wherein the zinc alloy melt-out core comprises at least 0.75% Cu, at least 0.1% Ni and at least 0.1% Al. As with the cores described above, this zinc alloy melt-out core preserves a space during the pressure casting process corresponding to the hollow in the aluminum cast article. The zinc alloy core maintains its integrity during the pressure casting process, inhibiting seepage of the core material into the aluminum article. Preferably, the level of Ni in the zinc alloy core is up to 0.3% by weight. The level of Al in the zinc alloy core may be up to 0.5% by weight.

As described in the process below, as the molten aluminum solidifies during the casting process, it transfers a certain amount of heat energy to the zinc alloy core. In some applications, it may be desirable to provide a coating of an insulating material on the outer shape-imparting surface of the zinc alloy core. The insulating material is applied as a thin layer or coating to the outer surface of the core and conforms substantially to the outer surface shape of the core. As such, the insulating material does not disturb to any significant extent the shape and size of the resultant cored space produced in the aluminum cast article. Preferably, the insulating material is non-porous and is not penetrated by the molten aluminum during the casting process. The insulating material preferably has a thickness of from about—0.01 to about 0.03 inches. Such insulating materials are known in the art and include mica, graphite, ceramics and combinations thereof. A preferred insulating material is mica. The mica insulating material is preferably applied as a dip coating by immersing the metal core in a water-based solution of mica material. A preferred mica dip coating material is available from Acme/Borden Corporation comprising a water-based mica refractory pre-mix slurry. One or more layers of the insulating material may be applied to achieve the desired thickness. The insulating material insulates the metal core from the heat of the molten aluminum and helps prevent the zinc alloy core from melting during the casting of the aluminum article.

In coating the zinc alloy core with an insulating material, the core is preferably heated to a temperature below its melting point, e.g., to about 180° F., before coating the outer surface of the core with the insulating material. After coating the zinc alloy core, the core is dried at an elevated temperature, e.g., 180° F., to drive off any water carrier to produce the solid substantially impermeable barrier insulating coating on the outer surface of the core.

In a method of producing an aluminum cast article according to this invention, a zinc alloy melt-out core as described above is formed. A preferred squeeze casting process is described in commonly assigned U.S. Pat. No. 5,355,933. The zinc alloy melt-out core has an outer shape-imparting surface corresponding generally to the cored space to be formed within the aluminum cast article. The zinc alloy core is positioned within the die cavity of a high-pressure casting die with the outer surface of the core exposed. Thus, the zinc alloy core preserves a space within the die cavity corresponding to size and shape to the cored space to be formed within the aluminum cast article.

The method then comprises introducing molten aluminum into the die cavity and against the core and pressurizing the aluminum sufficient to squeeze form the article in the die and around the core. A preferred aluminum material for use in casting the aluminum article is 356 grade aluminum commercially available from Alcoa. Casting apparatuses are commercially available through Ube Industries, Ltd. of Tokyo, Japan and is marketed under the trade name HVSC® casting machine. Preferably, the molten aluminum is injected into the die cavity under relatively low pressure, e.g., 15–20 psi, sufficient to move the aluminum into the die cavity and low velocity, e.g., 11.5 in/min, to initially fill the cavity with the molten aluminum.

Thus, the molten aluminum is injected initially into the die cavity at a relatively low velocity and pressure, introducing a slow, tranquil flow of aluminum into the die cavity to fill the cavity with the molten aluminum. As the molten aluminum fills the die, the aluminum directly contacts the zinc alloy core. The core is initially at room temperature. As the molten aluminum contacts the core, a thin skin or shell of the casting metal solidifies around the zinc alloy core, protecting the core against further direct contact with the molten aluminum.

Once the die cavity has been filled with the molten aluminum and as the molten aluminum is solidifying in the die cavity, the pressure is sharply increased to about 7,000–15,000 psi, causing the aluminum cast article to be squeeze-formed in the die cavity and around the core. Such high pressure squeezing essentially forges the article in the die closing any pockets of porosity that may form during solidification and increasing the mechanical properties of the final cast aluminum article.

As the molten casting aluminum solidifies, it transfers a certain amount of heat energy to the core. As described above, the zinc alloy core is able to withstand the heat of the aluminum without melting in the die. Once the molten aluminum has solidified in the die cavity to produce the resultant aluminum cast article, the casting die is opened and the aluminum cast article is removed along with the zinc alloy core from the die cavity. The zinc alloy core preferably extends out of the aluminum cast article beyond the perimeter of the article providing at least one access to the zinc alloy core material for extraction of the core material from the aluminum cast article.

Following casting of the aluminum cast article the aluminum cast article and the zinc alloy core are heated in an oven or by other means to a temperature above the melting temperature of the core material but below the melting temperature of the aluminum. This causes the zinc alloy core material to melt allowing it to be extracted from the aluminum cast article. The extracted zinc alloy core material may be recovered for re-use. In zinc alloy cores having an insulating coating, the insulating material must be also extracted from-the aluminum cast article in a known manner. For example, mica insulating material may be removed by immersing the aluminum cast article in warm water to loosen the mica allowing it to be extracted from the aluminum cast article.

Because nickel has the potential of acting as a scavenger of aluminum impurity, the zinc alloy melt-out cores as described above provide an additional benefit. The zinc alloy core material extracted from the aluminum cast article is preferably collected or recovered for re-use. The nickel and aluminum in the core material form intermetallics such as nickel aluminides. These intermetallics rise to the surface of the molten extracted zinc alloy core material. As such, these intermetallics may be skimmed off. The remaining zinc material may then be used to form a recycled zinc alloy melt-out core for use in a subsequent aluminum pressure casting process. Thus, the zinc material may be alloyed with copper, nickel, and aluminum for use in producing a zinc alloy melt-out core. A preferred process for producing the zinc alloy melt-out cores of the present invention includes a continuous casting process which is known in the art.

A preferred description of this invention has been disclosed; however, a worker of ordinary skill in the art would recognize that certain modifications would come within the scope of this invention. For that reason, the following claims should be studied in order to determine the true scope and content of this invention.

What is claimed is:

1. A method for producing an aluminum article having a hollow, said method comprising the steps of:

forming a zinc alloy melt-out core having an outer shape-imparting surface and comprising, by weight of the core, from 0.75% to 3% Cu, from 0.01% to 0.3% Ni, from about 0.01% to 0.5% Al, and balance zinc;

disposing the core in a die cavity of a high-pressure casting die with the outer surface of the core exposed for preserving a space within the cavity corresponding to a hollow space to be formed within an aluminum cast article;

introducing molten aluminum into the die cavity and against the core and pressurizing the aluminum sufficient to squeeze form the article in the die and around the core, the core being able to withstand the heat of the molten aluminum sufficiently to prevent the core from losing its original shape and the zinc alloy from seeping into the aluminum during casting of the article;

allowing the molten aluminum to solidify in the die cavity and about the core and opening the die and removing the cast article and core from the die cavity; and extracting the core from the article by heating the article and the core to a temperature above the melting temperature of the core but below that of the aluminum to liquify the core and thereby produce molten zinc alloy which is extracted from the cast article.

2. A method as recited in claim 1, wherein the step of forming the melt-out core further includes forming an outer coating of insulating material on the core, the insulating material selected from the group consisting of mica, graphite, ceramic and combinations thereof.

3. A method as recited in claim 1 further comprising using the molten zinc alloy to produce a recycled zinc alloy melt-out core for use in a subsequent aluminum pressure casting process.

4. A method as recited in claim 1 further comprising collecting the molten zinc alloy and allowing the Ni and Al to form a slag on the molten zinc alloy and then skimming the slag from the molten zinc alloy.

5. A method for producing an aluminum cast article having a hollow, said method comprising the steps of:

forming a zinc alloy melt-out core having an outer shape-imparting surface and comprising, by weight of the core, 1% to 2% Cu, from 0.15% to 0.25% Ni, and 0.15% to 0.5% Al, and balance zinc, by a continuous casting process;

disposing the core in a die cavity of a high-pressure casting die with the outer surface of the core exposed for preserving a space within the die cavity corresponding to a hollow space to be formed within an aluminum cast article;

introducing molten aluminum into the die cavity and against the core and pressurizing the aluminum sufficient to squeeze form the article in the die cavity and around the core, the core being able to withstand the heat of the molten aluminum sufficiently to prevent the core from losing its original shape and the zinc alloy from seeping into the aluminum during casting of the article;

allowing the molten aluminum to solidify in the die cavity and about the core and opening the die cavity and removing the cast article and core from the die cavity; and extracting the core from the article by heating the article and the core to a temperature above the melting temperature of the core but below that of the aluminum to liquify the core and thereby produce molten zinc aloy which is extracted from the cast article.

6. A method as recited in claim 5, wherein the step of forming the melt-out core further includes forming an outer coating of insulating material on the core, the insulating material selected from the group consisting of mica, graphite, ceramic and combinations thereof.

7. A method as recited in claim 5 further comprising using the molten zinc alloy to produce a recycled zinc alloy melt-out core for use in a subsequent aluminum pressure casting process.

8. A method for producing an aluminum article having a hollow, said method comprising the steps of:

forming a zinc alloy melt-out core having an outer shape-imparting surface and comprising, by weight of the core, 1% to 2% Cu, from 0.15% to 0.25% Ni, and 0.15% to 0.5% Al, and balance zinc, by a continuous casting process;

disposing the core in a die cavity of a high-pressure casting die with the outer surface of the core exposed for preserving a space within the cavity corresponding to a hollow space to be formed within an aluminum cast article;

introducing molten aluminum into the die cavity and against the core and pressurizing the aluminum sufficient to squeeze form the article in the die and around the core, the core being able to withstand the heat of the molten aluminum sufficiently to prevent the core from losing its original shape and the zinc alloy from seeping into the aluminum during casting of the article;

allowing the molten aluminum to solidify in the die cavity and about the core and opening the die and removing the cast article and core from the die cavity;

extracting the core from the article by heating the article and the core to a temperature above the melting temperature of the core but below that of the aluminum to liquify the core and thereby produce molten zinc alloy which is extracted from the cast article; and collecting the molten zinc alloy and allowing the Ni and Al to form a slag on the molten zinc alloy and then skimming the slag from the molten zinc alloy.

9. A method as recited in claim 8, wherein the step of forming the melt-out core further includes forming an outer coating of insulating material on the core, the insulating material selected from the group consisting of mica, graphite, ceramic and combinations thereof.

10. A method as recited in claim 8 further comprising using the molten zinc alloy to produce a recycled zinc alloy melt-out core for use in a subsequent aluminum pressure casting process.

* * * * *